United States Patent [19]

Holmen

[11] Patent Number: 4,749,463

[45] Date of Patent: Jun. 7, 1988

[54] ELECTROMETALLURGICAL CELL ARRANGEMENT

[75] Inventor: Hans K. Holmen, Vøyenenga, Norway

[73] Assignee: H-Invent A/S, Asker, Norway

[21] Appl. No.: 43,556

[22] PCT Filed: Jul. 4, 1986

[86] PCT No.: PCT/NO86/00048

§ 371 Date: Mar. 9, 1987

§ 102(e) Date: Mar. 9, 1987

[87] PCT Pub. No.: WO87/00211

PCT Pub. Date: Jan. 15, 1987

[30] Foreign Application Priority Data

Jul. 9, 1985 [NO] Norway ..... 852753

[51] Int. Cl.[4] ..... C25C 3/08; C25C 3/20; C25B 5/00

[52] U.S. Cl. ..... 204/241; 204/243 R; 204/246; 204/247; 204/274

[58] Field of Search ..... 204/241, 274, 243 R-247

[56] References Cited

U.S. PATENT DOCUMENTS

| | | | |
|---|---|---|---|
| 4,087,345 | 5/1978 | Sandvik et al. | 204/274 X |
| 4,222,841 | 9/1980 | Miller | 204/274 X |
| 4,481,085 | 11/1984 | Ishizuka | 204/274 X |
| 4,492,820 | 6/1986 | McGeer | 204/274 X |
| 4,608,135 | 8/1986 | Brown | 204/241 X |
| 4,647,355 | 3/1987 | Ishizuka | 204/274 X |

FOREIGN PATENT DOCUMENTS

| | | | |
|---|---|---|---|
| 0047227 | 3/1982 | European Pat. Off. | 204/241 |

*Primary Examiner*—Donald R. Valentine

*Attorney, Agent, or Firm*—Fleit, Jacobson, Cohn & Price

[57] ABSTRACT

In this field it is a problem to find practical technical solutions for heat recovery at the same time as regulation and control of the temperature conditions during cell operation is difficult, especially when cooling of the cell is intended. The arrangement comprises cooling chambers (6A, 6B, 6C, 6', 51) each having a base area covering a small proportion of the surface of each cell. Together these cooling chambers cover a substantial proportion of the cell surface without any significant space between the cooling chambers. These are adapted to receive a through-flow of a cooling medium which is controlled (8A, 8B, 8C) individually for each cooling chamber, and the cooling medium preferably is helium.

13 Claims, 2 Drawing Sheets

ELECTROMETALLURGICAL CELL ARRANGEMENT

Figure 1:
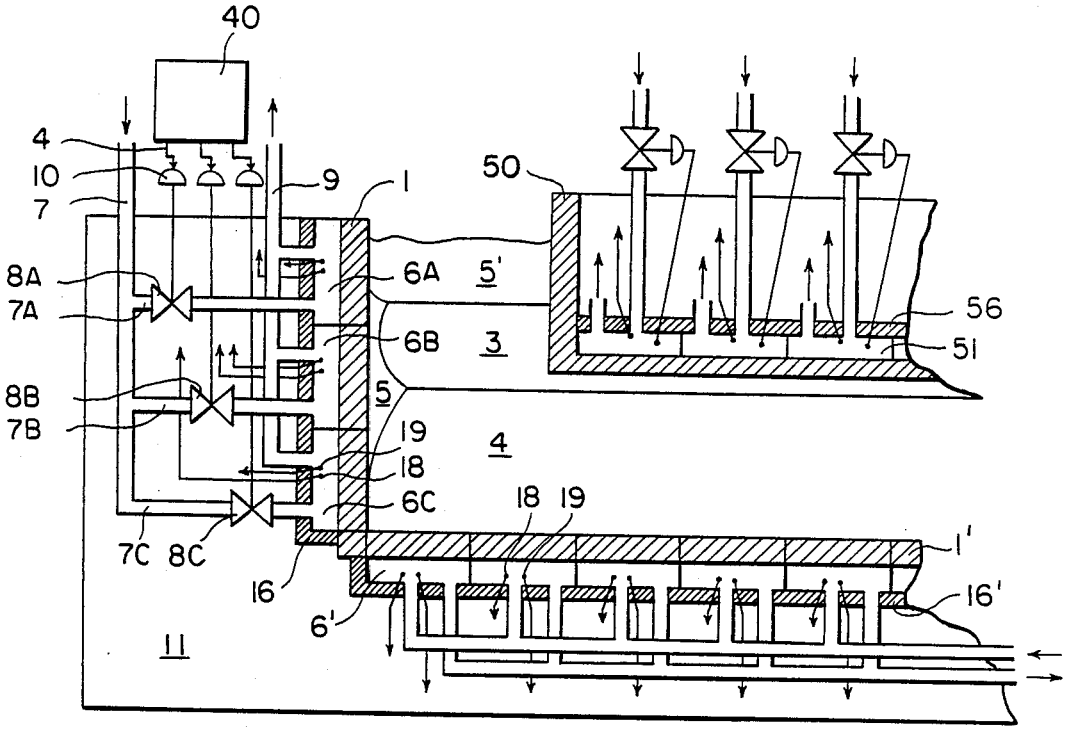

In the aluminum melting industry based on electrolysis and similar electrometallurgical industry large amounts of power is lost in the form of heat from the cells employed in the processes. As far as the running and the efficiency of the actual process is concerned, it is also very important to take into account the cooling conditions. Particularly in the recent time there has been a growing interest for energy economy and recovery, and thus there have been put forward various proposals for heat recovery in the above industry.

Examples of known proposals in this direction may be found in Published British Patent Application No. 2 076 428 and in Published West-German Patent Application No. 3 014 942. In the British application there is described removal of heat by means of a number of cooling elements in the sidewall of the cell. The cooling is controllable, inter alia by means of valves for the flow of cooling medium in each element. These cooling elements consist of pipes. The control takes place in response to heat sensors provided in the sidewall. The specification, however, does not give any explanation as to whether the purpose of the arrangement is to recover energy. The arrangement proposed aims at controlling the temperature in the cell, and more particularly in the cell bath.

On the other hand the German patent application describes recovery of energy with heat exchangers provided above the bath and in the sidewalls respectively, possibly also in the bottom. The purpose of this is to produce steam or electricity at the same time as the side coating (crust) shall be secured or maintained. The cell walls shall be well insulated. There is provided a cover above the bath so that the cell will be closed. A temperature sensor measures the electrolyte temperature.

In the practical operation of control, cooling and heat recovery of the kind concerned here it is of substantial significance to take into account the need for individual control of the temperature distribution at the side and bottom surfaces of cell boxes of the various types found within the electrometallurgic industry. Moreover, it is an important factor that the high and diverse stresses to which cells and auxiliary equipment are subjected within this industry, makes it necessary that all equipment installed near the process either without reservation stand up to the stresses concerned or that the equipment at least cannot cause any damage of significance if it should fail. As known it is usual in these industries to have full continuous operations, so that maintenance and replacement of parts must to the largest possible extent take place without interruption of the operation.

Cells for the aluminum electrolysis are constructed with a cell box having an internal refractory lining in bottom and walls. The structure of the bottom and walls is to a substantial degree aimed at withstanding the high temperatures and strong corrosive forces which occur by contact with the molten bath. Corresponding stresses act also on the bottom faces of the anode. These contact surfaces or parts of the cell which essentially delimit the bath sideways, downwards and upwards, are decisively significant to the above heat and temperature conditions.

The object of the present invention is to provide a new solution which to a high degree will satisfy the requirements which according to the above must be imposed to control systems and equipment in the electrometallurgical industry. At one hand it is here a question of making the operation of each cell more effective, and on the other hand to be able to utilize the heat output from the cell for recovering power.

Thus, more particularly this invention takes as a starting point a cell arrangement for electrometallurgical purposes, in particular aluminum electrolysis, of the type comprising a cell box having an internal refractory lining in the bottom and the walls, an anode, a heat exchanger associated with at least one of the contact surfaces against the bath and adapted to be controlled in response to temperature sensor means and a system for temperature control.

Primarily it is of interest to provide a heat exchanger in the sidewalls of the cell box and besides in the bottom thereof, but there may also be thought of situations in which a heat exchanger is located in the anode, in particular when contemplating new anode designs which may be developed. Advantageously the controllable heat exchanger can serve to secure a desired side coating or crust layer in the cell.

What is novel and specific to the arrangement according to the invention in the first place consists therein that the heat exchanger comprises cooling chambers each having a base area which covers only a small proportion of the area of the contact surface concerned, and which together cover a substantial proportion of the area of the contact surface without any significant space between the cooling chambers, and that the cooling chambers are adapted to have a throughflow of a cooling medium being controlled individually for each cooling chamber. Concerning in particular the cell walls and the bottom respectively, at the parts being covered by cooling chambers, the structure can have a significantly reduced total thickness and heat transfer resistance compared to what would be required when the cooling chambers were not present.

With this sub-division of the cooling or heat recovery system by means of the comparatively small chambers, there are formed separate flow or recirculation circuits which by suitable control makes it possible to adapt the cooling and the heat output respectively, at the different portions of the cell with high accuracy according to the local temperature conditions therein, in particular in the cell walls and bottom. Thereby it will be possible at one hand to obtain a cooling of the various portions of the cell so that there is obtained a desired temperature distribution in the cell itself and in particular in the cell walls, and on the other hand an optimal heat recovery. In this way there is also obtained an advantageous effect to the cell operation as such, since portions thereof having a tendency to for example undesireably increased temperatures, may be eliminated. The cell design itself can thereby also be carried out simpler and cheaper than according to the manner of construction now being common, because the cooling and heat recovery system takes care of the heat developed in a more favourable way than what has been the case hitherto. Not the least the arrangement according to the invention involves a possibility of operating with a significantly increased amperage and thereby an increased production, with the same cell design. This is due to the much more effective cooling effect which is obtained. Since that part of the cell box which is between the cooling system and the process or melt bath, has a low heat capacity and a low thermal resistance, the cooling can be controlled quickly so that a cell row can be regulated in a short time for a lower or a higher current.

Figure 2:
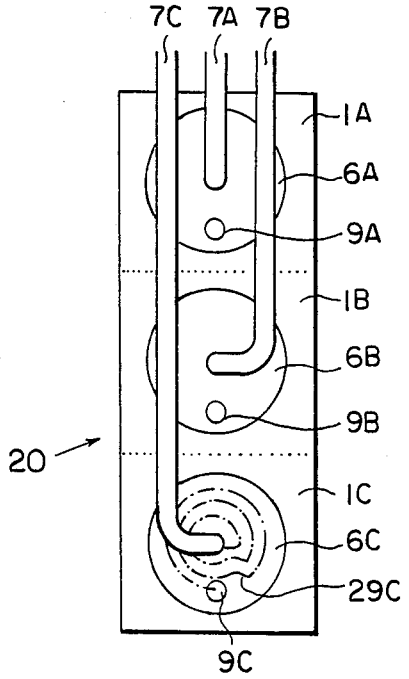
Figure 3:
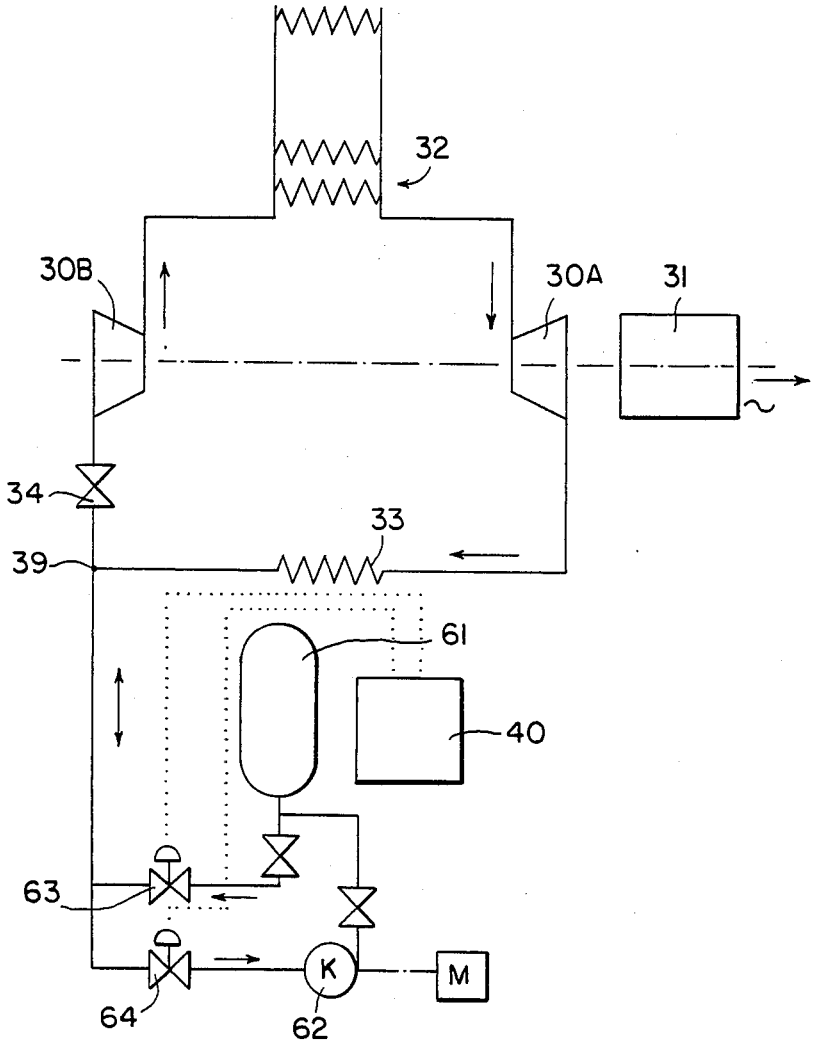

In the following description the invention shall be explained more closely with reference to the drawings, in which:

FIG. 1 shows a simplified cross-section of a part of the cell wall and bottom as well as the anode in an aluminum electrolytic cell provided with an arrangement according to the invention, FIG. 2 is a simplified elevation view of a sidewall module or block which can be included in the arrangement of FIG. 1, and FIG. 3 shows highly schematically a recirculation circuit for a cooling medium included in a system for temperature control with the arrangement according to the invention.

In accordance with common design practice the electrolytic cell in FIG. 1 has an internal refractory lining which comprises a bottom lining 1' and a wall lining 1. Suitably the lining can consist of a material having good properties with respect to the ability to resist corrosive attacks from the electrolyte and from molten aluminum, as well as reasonably good properties with respect to thermal and electrical conductivity. Nowadays it is common practice to use carbon based materials such as anthracite or graphite, but other materials cannot be excluded for this function. Possibly there may be applied a steel plate enclosure outside the lining, but this is not regarded as necessary in connection with this invention, since the practical construction of such a cell intended for an arrangement according to this invention, can take place more effectively without such a continuous plate structure which is common in conventional aluminum electrolytic cells.

Above the cell bottom there is shown a layer of molten aluminum 4 and on top of this an electrolyte layer 3 consisting of molten alumina and cryolite. Moreover, there is shown a side coating 5 and a crust layer 5' consisting of solidified cryolite. As known the side coating 5 has an important function in the cell operation, and it is very significant to effect control of the temperature conditions in the cell so that there is formed such a side coating 5 of suitable shape and thickness. The side coating serves inter alia to protect the wall lining 1 against the strong corrosive effect which may be caused by the electrolytic bath 3. In this connection the temperature gradient through the various layers from the melt bath 3, 4 out through the side coating 5 and the lining 1 is very important. The same also applies in part to the heat transfer conditions through the bottom structure of the cell.

The cell design according to FIG. 1 is specific in so far as the cell walls and bottom respectively, have a significantly reduced thickness of the lining and a low thermal resistance through the lining, compared to what has been used earlier in cell structures for electrometallurgical purposes, in particular aluminum electrolysis. In this branch of industry there has been a very conservative attitude to the dimensioning of such cell boxes, perhaps in particular because of the expensive and potentially dangerous consequences which may occur when a cell box is molten through so that the molten contents may flow out. By providing a cooling system as described here it will be possible to reduce to a high degree the dimensions and the material requirement for constructing these cell boxes, since the necessary control and local cooling is effected in a new and advantageous manner which is to be described in the following.

As will appear from FIG. 1 there is provided a heat exchanger system comprising cooling chambers 6A, 6B and 6C engaging the wall lining 1 and other cooling chambers 6' underneath the bottom lining 1'. Besides, there are shown cooling chambers 51 in the anode 50 of the cell.

The cooling chambers 6A, 6B and 6C on the cell wall have a base area or surface of engagement covering a comparatively small proportion of the sidewall of the cell. The base of the cooling chambers can advantageously have an approximate square shape. The cooling chambers are located with an unsignificant spacing and are adapted to receive a through-flow of a cooling medium with individual control for each cooling chamber.

As seen from the interior of the cell the cooling chambers (heat exchanger elements) 6A, 6B, 6C lie behind the lining 1 and further behind the chambers there is mounted a heat distributing plate 16 which in the first place has a safety function. The plate 16 shall distribute the heat to adjacent chambers if one of the chambers should fail, possibly at connections thereto. Finally a highly insulating material can be provided behind the heat distributing plate 16.

FIGS. 1 and 2 illustrate somewhat more in detail the cooling system for the cell wall, where the cooling arrangement described here is most significant. The cooling system comprises supply pipes 7A, 7B, 7C having a common supply as indicated at 7. For each cooling chamber 6A, 6B, 6C (FIG. 1) there are inserted control valves 8A, 8B and 8C respectively, in the corresponding supply pipes. Moreover, for these chambers there is shown a common return conduit 9 with short pipe sections to each of the chambers, of which the pipe section 9A for chamber 6A has been indicated specifically.

As essential parts of the system for temperature control of the cell shown, there is illustrated in FIG. 1 in a purely schematic and simplified manner, a control unit 40 which suitably can be a computer, and which delivers a setpoint through outputs indicated at 41, to a number of control devices 10 which in their turn actuate the above mentioned valves 8A, 8B and 8B. In addition to a setpoint from the control unit 40 there is applied to the control devices 10 one or more measurement values relating to the heat conditions in and in association with the cooling chambers 6A, 6B and 6C. Thus, in chamber 6C there is shown a temperature measuring element 18 and besides a heat flux meter 19, the measurement values from these elements being lead each to a separate control device 10 as shown. Thereby the flow of cooling medium can be controlled individually for each cooling chamber. In accordance with conventional control methods the control unit or computer 40 can calculate the respective setpoints on the basis of desired cell operation parameters and measurement values from different parts of the system or cell installation.

In connection with FIG.1 there is only mentioned three cooling chambers 6A, 6B and 6C above, but it is evident that a higher number of such cooling chambers are provided along the whole length of an electrolytic cell in order to cover a substantial portion of the wall surface. Cooling chambers are mounted over all those parts of the wall surface which is of significance for the cooling and control during operation of the cell.

According to the invention an advantageous embodiment consists therein that the cell wall is built up sectionally by modular blocks, of which one block or module is shown in FIG. 2. This figure shows the same three cooling chambers 6A, 6B and 6C as in FIG. 1, with associated supply pipes 7A, 7B and 7C respectively. For simplicity the valves in these pipes are not included in FIG. 2. Possibly the valves can be located outside the modular block so that the structure thereof will be somewhat simplified. For each cooling chamber 6A, 6B and 6C there is indicated an associated square lining part 1A, 1B and 1C which can either be composed of separate lining parts or may constitute a continuous element for the block. The cooling chambers are shown in FIG. 2 with a circular basic shape and have a central entry of the supply pipes 7A,7B and 7C. The connection of a return conduit (not shown) from each of these chambers is indicated at 9A, 9B and 9C respectively. Like the supply pipe 7A,7B and 7C the return conduit from each chamber can be extended vertically upwards for connection to the remaining circulation system at the upper edge of the cell wall, as indicated in FIG. 1.

In order to obtain a favourable circulation and distribution of the cooling medium in each cooling chamber these can be provided with internal distribution walls, as shown specifically in the cooling chamber 6C in FIG. 2. Thus, in relation to the circular shape of the cooling chambers shown therein, the distribution wall 29 in the chamber 6C has a spiral shape which leads the cooling medium in a spiral shaped flow path from the center out towards the connection to the return conduit at 9C adjacent the periphery of the chamber.

The measuring elements 18 and 19 are not shown in FIG. 2, but the location thereof will be in accordance with known principles for instrumentation. In addition to pure temperature measurement in the cooling medium, possibly in the wall lining, there can also be provided for measurement of heat flow in the chambers (heat flux meters 19).

The modular block 20 as shown in FIG. 2 can be mass produced with all associated elements and pipe fittings ready for mounting and coupling in connection with the construction of a new cell or restoration of a cell which has been in operation and initially based on a system as described here - possibly also as a replacement of the lining in a cell which has been based on earlier technology.

It has been emphasized already above that an arrangement of cooling chambers on the cell walls is the primary concern according to the invention. FIG. 1, however, also shows a heat exchanger with cooling chambers 6'underneath the bottom lining 1' of the cell, with associated circulation pipes for a cooling medium. As the temperature and heat conditions in the bottom are not so critical as they are along the cell walls, the cooling chambers 6' under the bottom do not have to be as small as explained in connection with the wall structure. Thus, the chambers 6' in the bottom can extend across a larger portion of the cell or possibly over the whole length thereof. Nevertheless it may be an advantage to have a heat distributing plate 16' included.

For a more complete heat recovery and possibly a desired cooling effect, there is also in the anode 50 shown cooling chambers 51 provided with corresponding conduits, valves and control devices corresponding more or less to those discussed above in relation to the sidewall of the cell. Also in the anode there can be provided a heat distributing plate 56 behind the cooling chambers. The provision of such cooling chambers in the anode requires a modified design thereof in relation to what is conventional techniques. With such cooling of the anode in aluminum electrolytic cells great advantages can be obtained.

As a cooling medium it is much preferred according to the invention to employ helium which at one hand has favourable flow properties and on the other hand is a favourable medium for heat transport. Moreover, it is important that helium is a one atom, inert gas and therefore does not involve danger when employed in connection with electrolytic cells comprising high temperatures, electric current and other risk factors. The use of helium is particularly advantageous when the control discussed or the temperature control to a substantial degree is intended for heat recovery and not only a pure cooling effect for purposes of the cell operation per se.

When the arrangement according to the invention shall be included in a system for heat recovery it is an important feature that the helium circulation takes place in a closed circuit for direct heat exchange to the high pressure side of a thermodynamic engine (expansion engine), for example a turbine, which utilizes heat recovered from the cell.

Helium is a one atom gas having a high Cp/Cv ratio and a low viscosity. This makes helium well suited as a working medium in a thermodynamic engine.

The principle for production of electric power by means of a closed gas circuit and a compressor, a high temperature heat exchanger, a gas turbine and a cooler is well known, and is designated Joule's ideal gas cycle. The theoretical maximum efficiency is lower than for Carnot's cycle, but it is not much lower. The equation for efficiency is given by:

$N = 1 - (P_1/P_2)\ (k-1)/k$ $P_1$ = Minimum pressure $P_2$ = Maximum pressure $K = Cp/Cv$ Cp = Specific heat at constant pressure Cv = Specific heat at constant volume.

For helium K is practically independent of temperature and pressure and equal to 1,67.

As shown by the equation, the efficiency increases with increasing pressure ratio. The problem is that the temperature in the gas increases strongly with an increasing degree of compression, and this involves that less heat can be absorbed per cycle when the maximum temperature is given.

The principle of the heat recovery is shown schematically and simplified in FIG. 3. FIG. 3 shows a heat exchanger 32 which comprises an arrangement of several cooling chambers as described above. From this heat exchanger 32 helium circulates to the high pressure side 30A of a turbine which drives a generator 31, for example for producing electric power. Moreover, helium circulates to a second heat exchanger 33 at the low pressure side, with a possible subsequent control valve 34 and then to the low pressure side (the compressor part) 30B of the turbine. From there the helium flow goes back to the heat exchanger 32 on the electrolytic cell or cells. This direct heat exchange from the cell to the high pressure side of the turbine aggregate involves a strong simplification of the whole heat recovery system and has been made possible inter alia by employing helium as the cooling medium, which permits a lower maximum pressure in the circulation system.

The secondary heat exchanger 33 makes it possible to utilize still further portions of the waste heat, for example for water heating.

When the generator 31 shall supply electric alternating current at a substantially constant frequency, for example 50 Hz, the rotational velocity of the turbine 30A should be kept constant with a varying heat transfer to the high temperature heat exchanger 32. Such variations will occur during normal operation of aluminum electrolytic cells. The regulation thereof takes place through changes in the amount of circulating helium, i.e. by pressure changes in the closed circuit. Introduction of helium increases the pressure, whereas extraction of helium from the circuit will lower the pressure therein. This is preferably done at point 39 in which there is a comparatively low pressure and low temperature, i.e. behind the low temperature heat exchanger 33.

Control of the pressure or amount of helium can be effected in various ways, but it is preferred not to consume or lose helium in this connection. Thus, in FIG. 3 there is shown a pressure tank or accumulator 61 for helium and an associated valve 63 which permits of a controlled supply of helium from the tank 61 to the circulation circuit at point 39. Moreover, there is provided a compressor 62 which through another valve 64 serves to control the lowering of pressure in the circuit, by transferring (compress) helium to the tank 61. During such a pressure lowering operation valve 63 is obviously closed.

The regulation described here can take place under the control of a calculating unit 40' which suitably can be constituted by or can be included as a part of the computer 40 in FIG. 1, whereby the relevant input signals for controlling the helium circulation will be obvious to an expert, the amperage at which the electrolytic cells are operated, being an important parameter.

The regulation arrangement with the pressure accumulator tank 61 and compressor 62 and associated valves can be common to a number of or all cells in an electrolysis plant, or such arrangement can be provided for each cell.

Control for obtaining a substantially constant rotational velocity as mentioned, is also advantageous with most interesting types of expansion engine (turbine) 30A and the associated compression engine (compressor) 30B. These types of engines as a rule have a relatively narrow range of rotational velocity with maximum efficiency.

I claim:

1. Cell arrangement for electrometallurgical purposes, in particular aluminum electrolysis, comprising a cell box having an internal refractory lining in the bottom and walls thereof, said internal refractory lining providing contact surfaces against a cell bath; an anode partially immersed within said cell bath; and a heat exchanger associated with at least one of said contact surfaces, said heat exchanger comprising a plurality of cooling chambers, each of said cooling chambers having a base area covering a small proportion of the area of the contact surface and said plurality of cooling chambers together covering a substantial proportion of the area of the contact surface without any significant space between said cooling chambers, said cooling chambers being adapted to receive a through-flow of a cooling medium which is controlled individually for each cooling chamber in response to a system for temperature control connected to temperature sensor devices within said cooling chambers; wherein said heat exchanger is directly incorporated in a closed circuit with an expansion engine and said cooling medium in said heat exchanger is a working medium in said expansion engine.

2. Arrangement according to claim 1 wherein the cell wall is built up of modular blocks each having a height corresponding approximately to the height of the cell wall and a width corresponding to the width of a cooling chamber, and comprising internal lining parts, a number of cooling chambers with associated pipe fittings and a heat insulating layer outside the cooling chambers and around the pipe fittings.

3. Arrangement according to claim 1, wherein cooling chambers are provided in the anode of the cell, said cooling chambers being included in the system for temperature control.

4. Arrangement according to claim 1 wherein the system for temperature control comprises a control unit which on the basis of desired cell operation parameters and measurements delivers a setpoint for the regulation of valves in supply pipes for cooling medium to each cooling chamber.

5. Arrangement according to claim 1 wherein the cooling medium consists of helium.

6. Arrangement according to claim 1 wherein the expansion engine is adapted to drive a generator for producing electric alternating current at a substantially constant frequency, comprising means for regulating the pressure at a point in the closed circuit where there is a relatively low pressure and low temperature.

7. Arrangement according to claim 1, comprising a pressure tank which through a valve serves to increase the pressure in the closed circuit, a compressor which serves to lower the pressure in the closed circuit by transferring cooling medium therefrom to the pressure tank, and another valve contributing to the control of the compressor, whereby the circulated amount of cooling medium is regulated by changing the pressure of the working medium.

8. Cell arrangement for electrometallurgical purposes, in particular aluminum electrolysis, comprising a cell box having an internal refractory lining in the bottom and walls thereof, said internal refractory lining providing contact surfaces against a cell bath; an anode partially immersed within said cell bath; a heat exchanger associated with at least one of said contact surfaces, said heat exchanger comprising a plurality of cooling chambers, each of said cooling chambers having a base area covering a small proportion of the area of the contact surface and said plurality of cooling chambers together covering a substantial proportion of the area of the contact surface without any significant space between said cooling chambers, said cooling chambers being adapted to receive a through-flow of a cooling medium which is controlled individually for each cooling chamber in response to a system for temperature control connected to temperature sensor devices within said cooling chambers; and a heat distributing plate of metal at the back of the cooling chambers and in good thermal contact therewith, said heat distributing plate being common to a plurality of cooling chambers.

9. Arrangement according to claim 8, wherein the cell wall is built up of modular blocks, each having a height corresponding approximately to the height of the cell wall and a width corresponding to the width of a cooling chamber, and comprising internal lining parts, a number of cooling chambers with associated pipe fittings, and a heat insulating layer outside the cooling chambers and around the pipe fittings.

10. Arrangement according to claim 8, wherein cooling chambers are provided in the anode of the cell, said cooling chambers being included in the system for temperature control.

11. Arrangement according to claim 8, wherein the system for temperature control comprises a control unit which on the basis of desired cell operation parameters and measurements delivers a setpoint for the regulation of valves in supply pipes for cooling medium to each cooling chamber.

12. Arrangement according to claim 8, wherein the cooling medium consists of helium.

13. Cell arrangement for electrometallurgical purposes, in particular aluminum electrolysis, comprising a cell box having an internal refractory lining in the bottom and walls thereof, an anode, and a heat exchanger comprising cooling chambers adapted to receive a through-flow of a cooling medium being controlled in response to a system for temperature control connected to a temperature sensor device, said heat exchanger being directly incorporated in a closed circuit with an expansion engine, wherein the cooling medium in the heat exchanger is a working medium in the expansion engine.

* * * * *